United States Patent [19]

Obermeier

[11] 4,150,941

[45] Apr. 24, 1979

[54] PHOTOELECTRIC CONTROL DEVICE FOR GAS BURNERS

[75] Inventor: Friedrich Obermeier, Niefern, Fed. Rep. of Germany

[73] Assignee: Firma Dr. Th. Wieland, Pforzheim, Fed. Rep. of Germany

[21] Appl. No.: 837,574

[22] Filed: Sep. 28, 1977

[51] Int. Cl.[2] ..... F23D 13/40

[52] U.S. Cl. ..... 431/355; 126/234; 126/238; 431/79

[58] Field of Search ..... 431/18, 355, 79; 126/234, 226, 238

[56] References Cited

U.S. PATENT DOCUMENTS

| | | | |
|---|---|---|---|
| 736,321 | 8/1903 | Walther | 126/234 |
| 3,188,836 | 6/1965 | Kniebes | 431/18 |
| 3,723,045 | 3/1973 | Reese | 431/18 |
| 4,028,047 | 6/1977 | Strunz et al. | 431/355 |

*Primary Examiner*—Edward G. Favors

*Attorney, Agent, or Firm*—Schwartz, Jeffery, Schwaab, Mack, Blumenthal & Koch

[57] ABSTRACT

A device for photoelectrically starting and stopping the operation of a bunsen burner in response to the shadow of an operator's hand holding an object to be heated includes a solenoid valve in a line supplying gas to the burner and electronic control circuitry having secondary and primary photoelectric cells arranged in a differential response circuit. Changes in the intensity of the ambient light are cancelled by the differential response circuit, while a hand shadow, which affects only the primary cell, triggers the solenoid valve, via a gate circuit and solenoid switch.

11 Claims, 4 Drawing Figures

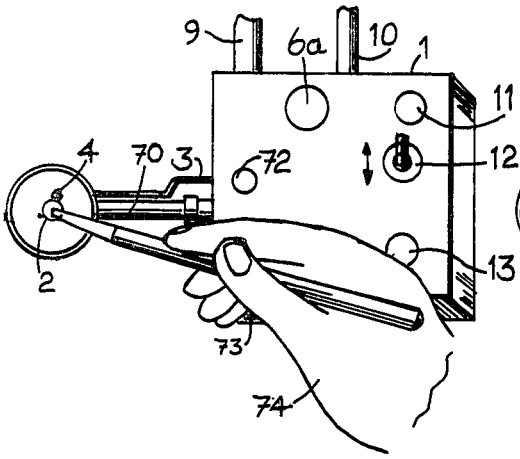
Fig 1
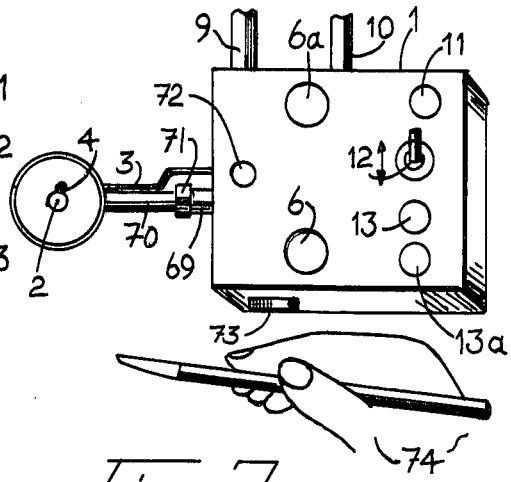
Fig 2
Fig 3
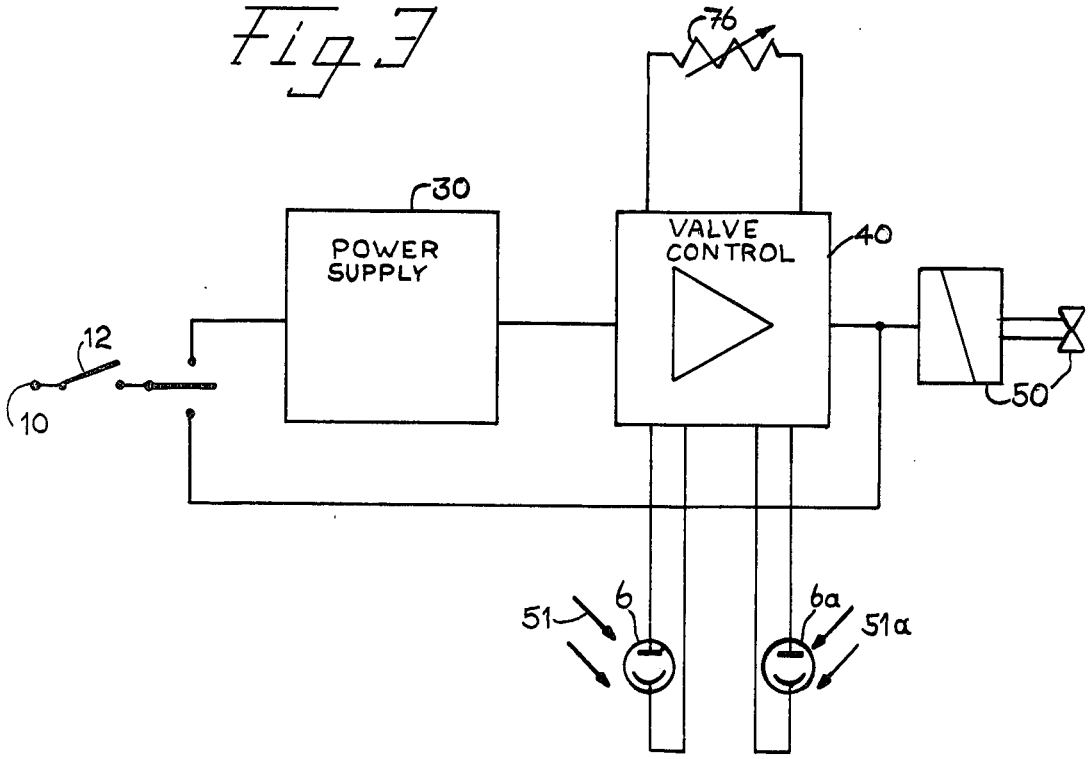

PHOTOELECTRIC CONTROL DEVICE FOR GAS BURNERS

BACKGROUND OF THE INVENTION

1. Field of the Invention

The present invention relates to photoelectrically controlled switching devices, and, more particularly, to a device for automatically starting and stopping a gas burner, especially a bunsen burner, in response to shading from ambient light of a photoelectric control sensor, due, for example, to the approach of a hand.

2. Description of the Prior Art

U.S. Pat. No. 4,028,047 discloses a bunsen burner with photoelectrically operated start-stop controls of the type mentioned above. This apparatus features a box-like housing with a flexible hose leading to a gas supply and an electrical cord for plug-in into an electrical wall outlet. A bunsen burner mounted on top of the housing is connected to the gas supply line via a solenoid-controlled shutoff valve. The solenoid is operated by a relay and a dimmer switch circuit which consists primarily of a photoelectric cell and an amplification stage.

The photoelectric cell is normally so adjusted that, under the incidence of ambient light, the solenoid valve remains closed and the bunsen burner is shut down. A directionally adjustable light tube above the photoelectric cell is oriented in such a way that the presence of an implement holding hand in the vicinity of the bunsen burner will reduce the incidence of light at the photoelectric cell by throwing a shadow over it, thereby triggering the solenoid valve to open the gas supply line. The burner flame is ignited by means of an electrical glow igniter or some other suitable ignition means. As soon as the operator removes his hand from the vicinity of the bunsen burner, the shadow disappears from the light tube and the dimmer switch circuit automatically shuts down the gas supply.

The advantages of this type of automatic burner operation are numerous. By completely eliminating the need for manually opening and closing the burner valve, it frees both hands of the operator. This feature is particularly useful in situations, where frequent short usage of a bunsen burner is common, as in the case in dental labs, for example. It is the current practice for a dental technician, rather than manually opening and closing the burner valve repeatedly, to simply leave the burner on, even when not needing it. The use of an automatically operating gas valve thus reduces to a minimum the time during which the gas flame is burning, thereby simultaneously minimizing the deterioration of the air in the lab, the consumption of energy, and the undesirable heating action of the burner on a hot day.

It has been found, however, that this prior art apparatus is subject to malfunction, under certain circumstances. This is particularly the case, when the ambient light in the area in which the burner is located is subject to fluctuations which can trigger the unintentional opening or closing of the solenoid valve, such as, when sunlight suddenly falls on the apparatus, or suddenly ceases to fall on the apparatus, or when interior electrical light sources are switched on or off.

SUMMARY OF THE INVENTION

It is the primary objective of the present invention to provide improved photoelectric start-stop controls for a gas burner of the type described above, by eliminating the shortcomings of this prior art apparatus, while retaining its operational advantages.

The present invention proposes to attain this objective by using a photoelectric control device with gas burners having a solenoid valve control circuit wherein the circuit utilizes first and second photoelectric cells. The first photoelectric cell is located on the outside of the apparatus so that light incidence there upon is reduced by the shadow of a hand in a normal operating position. The second photoelectric cell located on the outside of the apparatus so that it is exposed to substantially the same ambient light incidence as the first photelectric cell, but is not affected by the shadow of the hand. The two photoelectric cells are interconnected electronically so that a change in the level of ambient light is of no consequence to the output of the valve control circuit. This is accomplished by connecting the cells so that the resultant change in resistance of the first photoelectric cell is compensated for by an equivalent change in resistance of the second photoelectric cell. Accordingly a hand shadow, affecting only the first photoelectric cell, causes the valve control circuit to open and close a solenoid valve and to start and stop the operation of the burner.

In a preferred embodiment of this invention, the two photoelectric cells are located on top of a shallow housing and are spaced apart transversely a distance somewhat less than the width of a hand. Preferably the location of the first, hand-responsive photoelectric cell should be a longitudinal distance from the burner flame equal to approximately two-thirds of the length of a hand. A convenient arrangement is obtained, if the two photoelectric cells and the bunsen burner are located on the three corners of an isosceles triangle, and if the mouth of the bunsen burner is located at the same level, or only a small distance above the level of the photoelectric cells.

The preferred embodiment of the invention further includes an a.c. power supply circuit with a voltage divider and rectifier. The output values of the two photoelectric cells are fed to an integrating gate and amplifier stage controlling a thyristor switch. The latter directly controls the a.c. voltage to the solenoid of the solenoid valve.

BRIEF DESCRIPTION OF THE DRAWINGS

Further special features and advantages of the invention will become apparent from the description following below, when taken together with the accompanying drawings which illustrate, by way of example, a preferred embodiment of the invention, represented in the various figures as follows:

FIG. 1 is a top view of an apparatus embodying the invention showing a hand in operating position;

FIG. 2 is also a top view of the apparatus of FIG. 1, but the operator's hand is shown located outside of the operating position;

FIG. 3 is a block diagram showing, the relationship between the major components of the apparatus of the invention.

DESCRIPTION OF THE PREFERRED EMBODIMENT

Figure 4:
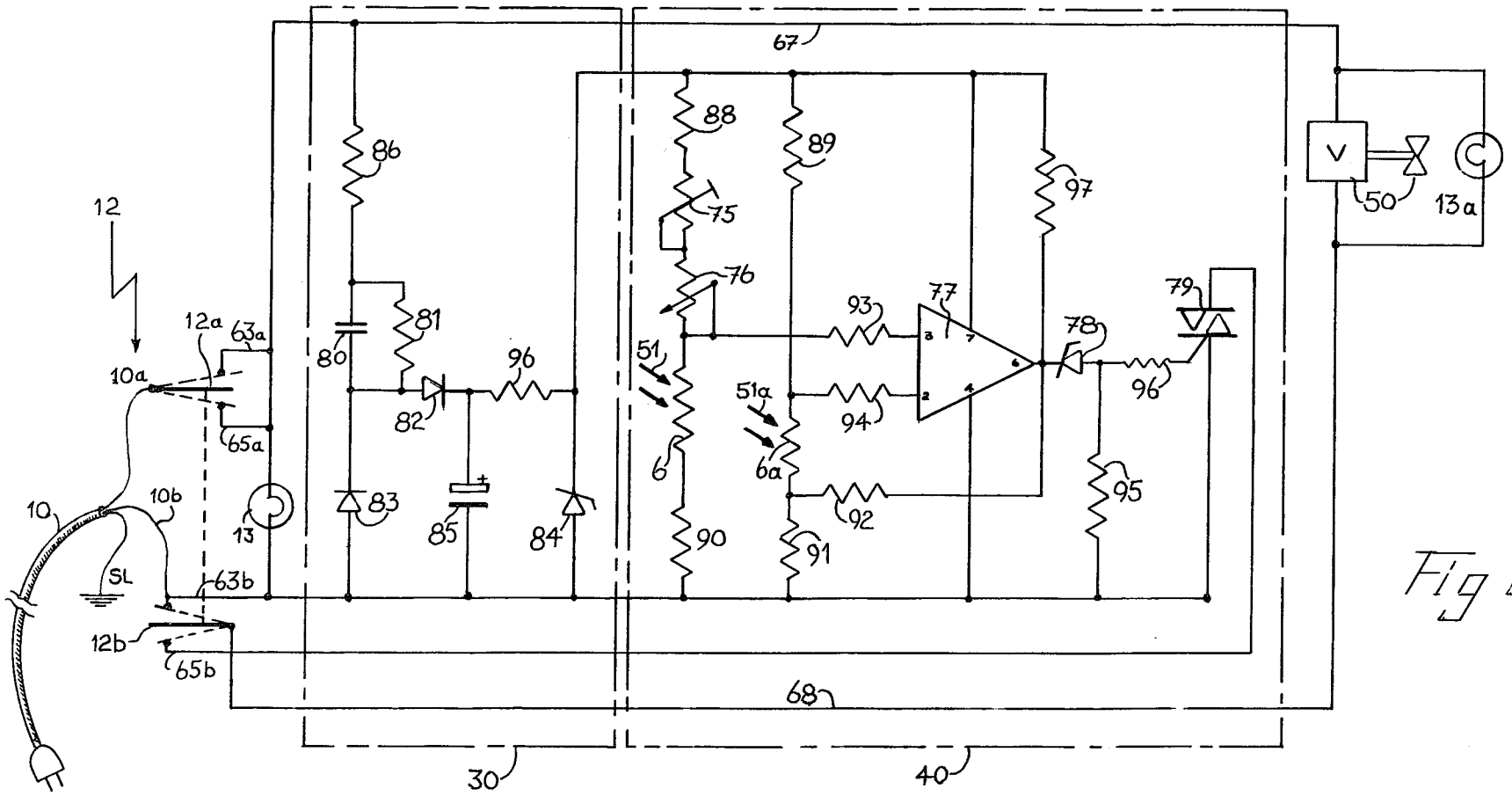
FIG. 4 is a circuit diagram showing the operating components of the apparatus of FIGS. 1-3.

The various mechanical and electrical details of a preferred embodiment of the invention are shown in FIGS. 1-4 of the drawings, which show a bunsen burner designed for use on a table or work bench, for example. A top view of such an apparatus in operation is shown in FIGS. 1 and 2.

The essential operating components of the apparatus and their functional relationships are shown diagrammatically in FIG. 3 in conjunction with FIGS. 1 and 2. The apparatus has an a.c. supply 10, for connection to a standard outlet of an electrical supply network. A main switch 12 serves to select the operating mode, which may be either "off", or "on" in a permanent operation mode, or "on" in an automatic mode. When in the permanent operation mode, the photoelectric controls are simply bypassed, and the solenoid valve remains open, until the main switch is moved to the "off" position. In the automatic operation mode, the apparatus uses an a.c. power supply circuit 30 to produce a d.c. potential of twenty-four volts for a valve control circuit 40. The latter includes, as primary components, a plurality of photoelectric cells, preferably two photoelectric cells 6 and 6*a*. The resistance of the photoelectric cells 6 and 6*a* changes as a function of the intensity of light incidence 51 on cell 6 and light incidence 51*a* on cell 6*a*.

The valve control circuit 40 is designed so that a change in the resistance output of the first photoelectric cell 6 produces a switching action on the solenoid valve 50. The size of the required resistance change is adjustable by means of a sensitivity potentiometer 76. To this extent, the operation of the apparatus is comparable to that of the prior art apparatus described in U.S. Pat. No. 4,028,047. which is incorporated herein by reference. Thus, if the light incidence 51 on the primary photoelectric cell 6 diminishes, as when an operator's hand 74 moves over it (FIG. 1), the valve control circuit 40 switches to energize the solenoid valve 50, thereby opening the main gas supply to the bunsen burner 2. As soon as the operator's hand 74 is removed (FIG. 2) and the photoelectric cell 6 again receives its full light incidence 51, the valve control circuit 40 reverts to the off mode, deenergizing the solenoid valve 50.

As can be seen in FIG. 2, the secondary photoelectric cell 6*a* receives substantially the same light incidence as the primary photoelectric cell 6, so long as the primary cell 6 is fully exposed to ambient light. Ambient light should be understood as that light condition which exists in the immediate area of the apparatus, when the latter is not shaded by an operator's hand or some other moving object. The ambient light may or may not be augmented by the flame of the bunsen burner 2. Generally, however, the amount of light produced by the bunsen burner is only a small fraction of the total ambient light. The two photoelectric cells 6 and 6*a* have identical response characteristics, so that a change in the intensity of the ambient light results in identical changes in the output resistances of both photoelectric cells.

In the valve control circuit 40, the outputs of the two photoelectric cells 6 and 6*a* are fed to a gate circuit which is in the form of an integrated switching amplifier 77. As long as the output resistances of the two photoelectric cells 6 and 6*a* remain the same. The gate circuit 77 produces no output signal regardless of any changes in the absolute value of the output resistances of the photocells. This means that a change in the intensity of the ambient light, while producing a corresponding change in the output signal of the primary photoelectric cell 6, also produces a compensating identical change in the output signal of the output of the secondary photoelectric cell 6*a*.

If only the output resistance of the primary photoelectric cell 6 changes, as when a hand reduces the intensity of the light which falls on the cell, then the signals received by the switching amplifier 77 from the two photoelectric cells are out of balance and the amplifier responds with a switching signal, so that the solenoid valve will be opened by means of a suitable a.c. switch. The latter may be of the gate-controlled, solid state type switch, preferably a thyristor, or a Triac*79 (FIG. 4). In essence, the switching amplifier 77 serves as a comparator circuit which provides a triggering signal on the output thereof which actuates the thyristor or triac 79 to open the a.c. line 68 so that a.c. line current will flow to the solenoid valve 50. The sensitivity potentiometer 76 which is connected to the primary photoelectric cell 6 determines the threshold output inbalance between the photoelectric cells at which the switching amplifier 77 triggers the Triac 79 for startup of the gas burner. As can be seen in FIG. 4, the solenoid of the solenoid valve 50 is energized directly by the a.c. line voltage. As soon as the cause of the output inbalance at the photoelectric cells has disappeared, i.e. when the shadow of the operator's hand is no longer present above the primary cell 6, then the switching amplifier 77 discontinues its switching signal to the Triac 79 which, in turn, switches off the solenoid valve 50.

*Trademark of General Elelctric Co.

The circuit diagram of FIG. 4 represents an exemplary embodiment of the invention, with electrical control components and connections which have been found to operate satisfactorily. The electrical cord 10, with a conventional plug for connection to a wall outlet, has a phase lead 10*a* connected to the switching member 12*a* of the main switch 12 and a neutral lead 10*b* connected to the switching member 12*b* of the same switch.

The main switch 12 has three positions: an upper operating position, a lower operating position and a intermediate "off" position. In the upper operating position, shown in stippled lines, the switching members 12*a* and 12*b* touch the fixed contact elements 63*a* and 63*b*, so that both leads 10*a* and 10*b* of the a.c. supply voltage are connected directly to the terminals of the solenoid valve 50, via lines 67 and 68 bypassing the circuits 30 and 40. This means that the main gas valve will be held open and the burner will be operating, for as long as the main switch 12 remains in this position. The a.c. power supply circuit 30 and the valve control circuit 40 with its photoelectric cells are not in operation because they are bypassed.

When the main switch 12 is in the lower operating position, shown in dotted lines, its switching members 12*a* and 12*b* engage the fixed contact elements 65*a* and 65*b*, respectively. The contact 65*a* again directly connects the phase lead 10*a* of the a.c. supply voltage to one of the terminals of the solenoid valve 50, while the contact 65*b* connects the output side of the Triac 79 to the other terminal of the solenoid valve 50. The input side of the Triac 79 is connected to the neutral lead 10*b*, so that the state of the solenoid valve 50 is controlled by the switching state of the Triac 79 resulting in automatic operation of the device.

In this "automatic operation" mode of the device, the a.c. voltage is also supplying an a.c. power supply circuit 30, where a voltage divider, consisting of capacitor 80, resistance 81, and two diodes 82 and 83, produces a 24-volt d.c. potential. An input resistance 86, an output resistance 96, a smoothing electrolyte capacitor 85, and a voltage-regulating zener diode 84 complete the a.c. power supply circuit 30.

The valve control circuit 40 comprises the two photoelectric cells 6 and 6a which represent resistances in two parallel branches. After assembly of the device, an initial adjustment of the response sensitivity of the primary photoelectric cell 6 can be made by means of a trimming resistor 75, thereby compensating for production differences in the characteristics of the various resistors. A separate sensitivity potentiometer 76 serves to set the response threshold, i.e. the size of the resistance change in the branch of the primary photoelectric cell 6 which is necessary for the integrated switching amplifier 77 to respond with a switching signal at its output side. The potentiometer 76 is hand-adjustable by means of a tuning button, shown at 11 in FIG. 1.

The switching signal of the integrated switching amplifier 77 is fed to the Triac 79, via another zener diode 78 through suitable resistances 95–97. Additional resistances 88–91 in the branch lines of the primary and secondary photoelectric cells 6 and 6a serve to balance out the valve control circuit 40. The two photoelectric cells are preferably of the cadium-sulfide type.

A complete apparatus embodying the invention, designed for use with a bunsen burner for bench top use, is illustrated in FIGS. 1 and 2. The compact housing 1 has a block-shaped outline, on an approximately square supporting base. In this housing are arranged the earlier-described circuitry components of the a.c. power supply circuit 30 and the valve control circuit 40. A gas supply line 9 is connected to the back side of the housing 1, near the point of connection of the electrical cord 10. A connecting socket 69 and a laterally extending angled main tube 70 for the bunsen burner 2 are positioned on the left-hand side of the housing 1. A pilot branch line 3 runs parallel to the main tube 70, leading to a pilot flame orifice 4. The amount of air flowing to the main burner orifice 2 can be adjusted by a threaded air adjusting sleeve 71 which covers lateral openings in the main tube 70. The size of the pilot flame can be adjusted on the throttle screw 72. On the front side of the housing 1 is arranged in knurled knob 73 which serves as throttle knob to adjust the size of the burner flame.

The main switch 12 on the top side of the apparatus is a toggle switch with the three positions "off", "permanent operation", and "automatic operation" which have been described in detail further above. Two control lights 13 and 13a indicate the operating condition of the device. The control light 13, of red color for example, indicates that the apparatus has been switched on, while the control light 13a, of green color for example, indicates that the solenoid valve 50 is energized (see also FIG. 4).

The two photoelectric cells 6 and 6a are arranged near the front and rear edges of the top side of the apparatus the housing 1 of which provides a support for the photocells, the primary cell 6 being arranged in front, so that it will be shaded from the ambient light by the approach of the operator's hand 74, as illustrated in the drawing. Both photoelectric cells are covered by suitable light-permeable protective caps. It has been found that, if the apparatus is designed as a bunsen burner for use in a dental laboratory, for example, the distance between the primary photoelectric cell 6 and the orifice of the bunsen burner 2 should preferably be equal to approximately two-thirds of the length of a hand. Also arranged on the top side of the apparatus is a tuning knob 11 which determines the sensitivity of the switching response of the primary photoelectric cell 6 by setting the potentiometer 76 of the valve control circuit 40 (FIG. 4).

The apparatus, as illustrated in FIGS. 1 and 2, is adapted for use by a right-handed operator. It will be readily understood that only minor routine modifications are required to convert this apparatus for use by a left-handed operator.

The device of the invention is preferably operated and adjusted in the following manner: Unless shut down for an extended period of time, the pilot flame at the orifice 4 remains burning, and the electrical cord 10 remains plugged in. To test the operation of the solenoid valve 50, or for permanent operation, the main switch 12 is moved to the "permanent operation" position. Before using the apparatus in the "automatic operation" mode, the light sensitivity knob 11 is rotated to the position for highest sensitivity, i.e. lowest switching threshold so that when the main switch 12 is moved to the "automatic operation" position, the control circuit 40 immediately responds by opening the solenoid valve 50, thereby starting the main flame at the burner 2. The knob 11 is then rotated in a direction to reduce sensitivity and increase the switching threshold, until the control circuit 40 responds by shutting down the burner flame. A sensitivity adjustment just slightly beyond this point is usually the most preferable. With the apparatus adjusted in this manner, the mere approach and withdrawal of the operator's hand, as shown in FIGS. 1 and 2, will cause the flame at the burner 2 to start and stop automatically, without the apparatus ever being touched.

It should be understood, of course, that the foregoing disclosure describes only a preferred embodiment of the invention and that it is intended to cover all changes and modifications of this example of the invention which fall within the scope of the appended claims.

I claim the following:

1. Apparatus for controlling the operation of a fluid fuel burner wherein the burner has a fuel supply line with a valve disposed therein, the operation of which is photoelectrically controlled to open when light incidence upon the apparatus is reduced and to close when light incidence upon the apparatus is increased, the apparatus comprising:

first and second photoelectric means for sensing incident light, said photoelectric means positioned for receiving light incident on distinct, spaced apart portions of said apparatus;

comparator means connected to the photoelectric means for comparing outputs of the photoelectric means to one another to provide a triggering signal on an output thereof when the outputs of the photoelectric means are not balanced; and switch means connected between the comparator means and the valve for actuating the valve to open in response to the triggering signal.

2. The apparatus of claim 1 further comprising an a.c. line connected to the valve for providing the valve with a.c. line voltage and power supply means for converting the a.c. line voltage to low voltage d.c. to power the comparator circuit.

3. The apparatus of claim 2 wherein the switch means comprises a thyristor in the a.c. line having a collector connected to the comparator means wherein when the triggering signal occurs a.c. line current is passed to the valve to open the valve.

4. The apparatus of claim 3 including manual switch means in the a.c. line for bypassing the thyristor circuit and connecting the valve directly to the a.c. line.

5. The apparatus of claim 1 wherein the fluid fuel burner is a bunsen burner; wherein the first and second photoelectric means comprise a pair of photocells, and wherein the apparatus includes a support upon which the photocells are mounted in spaced relation to one another and in juxtaposition with the burner, whereby when the hand of an operator casts a shadow on one photocell the intensity of light incident thereupon is reduced without substantially effecting the intensity of light incident on the other photocell thereby creating the imbalance in the comparator means, actuating the switching means and opening the valve to pass fuel.

6. The apparatus of claim 5 further comprising an a.c. line connected to the valve for providing the valve with a.c. line voltage and power supply means for converting the a.c. line voltage to low voltage d.c. to power the comparator circuit.

7. The apparatus of claim 6 wherein the switch means comprises a thyristor in the a.c. line having a collector connected to the comparator means wherein when the triggering signal occurs a.c. line current is passed to the valve to open the solenoid valve.

8. The apparatus of claim 7 including manual switch means in the a.c. line for bypassing the thyristor circuit and connecting the valve directly to the a.c. line.

9. The apparatus of claim 5 wherein the bunsen burner is displaced horizontally from the support and the support positions the photocells just below the level of the bunsen burner flame with at least one of the photocells spaced from the burner a distance equal to approximately two-thirds the length of a hand.

10. The apparatus of claim 5 further including a pilot light on the bunsen burner for igniting the gas passed when the solenoid valve is opened.

11. The apparatus of claim 5 wherein the valve is a solenoid operated valve.

* * * * *